US010927844B2

(12) United States Patent
Gashi

(10) Patent No.: US 10,927,844 B2
(45) Date of Patent: Feb. 23, 2021

(54) MACHINE EQUIPPED WITH AN AIR COMPRESSOR OR WATER PUMP

(71) Applicant: Belenos Clean Power Holding AG, Bienne (CH)

(72) Inventor: Rexhep Gashi, Givisiez (CH)

(73) Assignee: Belenos Clean Power Holding AG, Bienne (CH)

( * ) Notice: Subject to any disclaimer, the term of this patent is extended or adjusted under 35 U.S.C. 154(b) by 74 days.

(21) Appl. No.: 15/565,791

(22) PCT Filed: Mar. 17, 2016

(86) PCT No.: PCT/EP2016/055828
§ 371 (c)(1),
(2) Date: Oct. 11, 2017

(87) PCT Pub. No.: WO2016/165906
PCT Pub. Date: Oct. 20, 2016

(65) Prior Publication Data

US 2018/0119703 A1 May 3, 2018

(30) Foreign Application Priority Data

Apr. 13, 2015 (EP) ..... 15163421

(51) Int. Cl.
*F04D 29/046* (2006.01)
*F04D 29/056* (2006.01)
(Continued)

(52) U.S. Cl.
CPC ..... *F04D 29/0467* (2013.01); *F04D 25/00* (2013.01); *F04D 29/046* (2013.01);
(Continued)

(58) Field of Classification Search
CPC .. F04D 29/0467; F04D 29/046; F04D 29/049; F04D 29/056; F04D 29/059;
(Continued)

(56) References Cited

U.S. PATENT DOCUMENTS 1,974,678 A * 9/1934 Lafont ..... F04D 13/086 417/365
2,839,005 A * 6/1958 Means ..... F01D 15/08 415/111
(Continued)

FOREIGN PATENT DOCUMENTS

CN 103727043 A 4/2014
EP 0 318 638 A2 6/1989
(Continued)

OTHER PUBLICATIONS

International Search Report dated Jun. 2, 2016 in PCT/EP2016/055828 filed Mar. 17, 2016.

*Primary Examiner* — Nathan C Zollinger
(74) *Attorney, Agent, or Firm* — Oblon, McClelland, Maier & Neustadt, L.L.P.

(57) ABSTRACT

A machine including: a main frame including at least one functional element and one control unit; an air compressor or water pump integrated in the main frame, including a frame in which are mounted a stator, a rotor interacting with the stator and including a shaft, at least one turbine carried by the shaft, a fluid-supply channel to the turbine, and an outlet channel for compressed fluid, the shaft being mounted rotatably on the frame about an axis by first and second bearings, including respectively first and second spherical elements provided on respective first and second ends of the shaft and centered relative to the axis of the shaft, and respective first and second housings provided in the frame
(Continued)

centered relative to the axis of the shaft and to support the respective first and second spherical elements.

12 Claims, 3 Drawing Sheets

(51) Int. Cl.

| | |
|---|---|
| ***F04D 25/00*** | (2006.01) |
| ***F04D 29/40*** | (2006.01) |
| ***F04D 17/10*** | (2006.01) |
| ***F04D 1/00*** | (2006.01) |
| ***F04D 13/00*** | (2006.01) |
| ***F04D 13/16*** | (2006.01) |

(52) U.S. Cl.
CPC ..... *F04D 29/056* (2013.01); *F04D 29/40* (2013.01); *F04D 1/00* (2013.01); *F04D 13/00* (2013.01); *F04D 13/16* (2013.01); *F04D 17/10* (2013.01)

(58) Field of Classification Search
CPC . F04D 17/10; F04D 1/00; F04D 13/00; F04D 13/06; F04D 13/16; F04D 25/00; F04D 25/06; F04D 29/40; F16C 19/00; F16C 19/50
See application file for complete search history.

(56) References Cited

U.S. PATENT DOCUMENTS

| | | | | |
|---|---|---|---|---|
| 3,269,117 | A * | 8/1966 | Tweet | F02K 3/00 60/39.08 |
| 3,951,573 | A * | 4/1976 | Dunning | F16C 33/107 417/423.13 |
| 4,865,529 | A * | 9/1989 | Sutton | F04D 13/04 417/409 |
| 5,649,425 | A * | 7/1997 | Matsumura | F01K 25/10 60/648 |
| 5,982,064 | A * | 11/1999 | Umeda | F16C 21/00 310/61 |
| 2004/0200454 | A1 | 10/2004 | Ibrahim et al. | |
| 2011/0038719 | A1 | 2/2011 | Wollstadt et al. | |
| 2020/0032808 | A1* | 1/2020 | Pae | F04D 13/06 |
| 2020/0116151 | A1* | 4/2020 | Pae | F04D 1/14 |

FOREIGN PATENT DOCUMENTS

| | | | |
|---|---|---|---|
| EP | 1 469 189 | A1 | 10/2004 |
| EP | 2 562 298 | A2 | 2/2013 |
| JP | 2010-168904 | A | 8/2010 |
| KR | 10-2009-0126661 | A | 12/2009 |

* cited by examiner

MACHINE EQUIPPED WITH AN AIR COMPRESSOR OR WATER PUMP

CROSS-REFERENCE TO RELATED APPLICATIONS

This is a National phase Application in the United States of International Patent Application PCT/EP2016/055828 filed on Mar. 17, 2016 which claims priority on European patent application No. 15163421.9 filed on Apr. 13, 2015. The entire disclosure of the above patent applications are, hereby incorporated by reference.

FIELD OF THE INVENTION

The present invention relates to a machine comprising a main frame including at least one functional element and one control unit, and equipped with an air compressor or water pump, and more particularly a high-speed air compressor or water pump.

BACKGROUND OF THE INVENTION

Fluid compressors equipping such machines are generally termed turbocompressors or centrifugal compressors. They are equipped with a stator and a rotor forming a permanent-magnet synchronous motor (brushless motor). Compressors of this type can reach very high speeds, for example 100,000 to 500,000 rpm. The motor drives the high-speed turbine, the turbine compressing the fluid. The fluid can be air, water, a gas, a refrigerant or any other suitable fluid. These compressors are used in numerous industrial, medical, pharmaceutical, foodstuff, automobile applications, in particular for supplying compressed air, or in refrigeration, heating or air-conditioning applications, for supplying compressed fluid.

These compressors are generally used in installations with very large dimensions, the compressor being at a remove from the equipment which requires compressed fluid. The compressed fluid is supplied by means of a supply circuit provided in the network. Generally, this supply circuit is long which involves risks of leakages of fluid along the circuit. Leakages in a compressed air circuit involve losses of pressure, which generates very high financial losses.

Furthermore, because of the distance separating the compressor from the equipment which requires the compressed fluid, the network is permanently maintained under pressure in order to be able to respond rapidly as needed to the equipment. The permanent functioning of the compressor represents a high consumption of electrical energy.

Furthermore, in these compressors, the motor shaft is mounted rotatably on a frame by means of two axial bearings. The bearings can comprise ball bearings. However, it is difficult to obtain speeds of rotation with such ball bearings because of the difference in speed between the balls and the ball races. Furthermore, although the balls used are made of ceramic, the life span of such bearings is limited to about one hundred hours because of the high speeds of rotation. Other types of bearing can be used, such as aerodynamic bearings. However, this type of bearings has the disadvantage of being displaced transversely at the moment of start-up or during a change in speed, which creates friction at the level of the bearing elements.

Finally compressors are generally lubricated by means of a lubricant. The disadvantage is that the lubricant risks becoming mixed with the fluid such that the compressed fluid is polluted by the lubricant. Likewise, impurities present in the central network can be mixed with the compressed fluid. This is particularly dangerous, for example in the case of medical applications, such as dental applications, for which the compressed air reaching the mouth must be safe.

SUMMARY OF THE INVENTION

The object of the invention is in particular to remedy the various disadvantages of machines equipped with known high-speed compressors.

More particularly, an object of the invention is to provide a machine comprising equipment which requires compressed fluid and which has autonomous functioning.

The object of the invention is likewise to provide a machine comprising equipment which requires compressed fluid and which makes it possible to reduce the consumption of electrical energy and to limit the energy losses associated with leakages along the fluid circuit.

The object of the invention is likewise to provide a machine comprising a high-speed air compressor or water pump which does not require a lubricating agent and does not involve any pollution of the compressed fluid.

To this end, the present invention relates to a machine comprising a main frame comprising at least one functional element and one control unit.

According to the invention, said machine comprises an air compressor or water pump integrated in the main frame, said air compressor or water pump comprising a frame in which there are mounted a stator, a rotor interacting with said stator to form a synchronous motor and comprising a shaft, at least one turbine carried by said shaft, a fluid-supply channel to the turbine, and an outlet channel for compressed fluid, the shaft of the rotor being mounted rotatably on the frame about an axis by means of a first and a second bearing, said first, respectively said second, bearing comprising:

- a first, respectively a second, spherical element provided for a first, respectively a second, end of the shaft and disposed centred relative to the axis of the shaft, and
- a first, respectively a second, housing provided in the frame and having the form of a cap disposed centred relative to the axis of the shaft and provided in order to support said first, respectively said second, spherical element, and said main frame comprises a fluid inlet provided in order to supply the air compressor or water pump and a supply circuit provided in order to supply the compressed fluid to the functional element.

Hence, the machine according to the invention is particularly compact, makes it possible to reduce the length of the compressed fluid-supply circuit so as to limit losses, and functions autonomously.

Furthermore, it integrates an air compressor or water pump which is able to turn at very high speed, without using a lubricating agent which is capable of polluting the compressed fluid.

Advantageously, the first housing can be provided in the fluid-supply channel.

According to one particularly preferred embodiment, said first housing can be provided in a first support element disposed centred relative to the axis of the shaft in the fluid-supply channel, and retained on the walls of said fluid-supply channel by means of branches between which the fluid can circulate.

Advantageously, the second housing can be provided in a second support element disposed in the frame centred relative to the axis of the shaft and opposite the first support element.

According to a preferred embodiment, the second support element can be mounted to slide in the frame and be connected to said frame by elastic means which are provided in order to absorb clearance variations between the rotor and the stator.

Advantageously, at least two aerodynamic bearings are provided, in addition, substantially on each side of the shaft of the rotor.

According to one embodiment, a first aerodynamic bearing can be provided upstream of the turbine, said first aerodynamic bearing being carried by a third support element disposed centred relative to the axis of the shaft in the fluid-supply channel, and retained on the walls of said fluid-supply channel by means of branches between which the fluid can circulate.

According to another embodiment, a first aerodynamic bearing can be provided downstream of the turbine.

Advantageously, a second aerodynamic bearing can be provided at the level of the end of the shaft of the rotor, on the opposite side to the fluid-supply channel.

According to a preferred embodiment, at least one of the first and second ends of the shaft of the rotor can comprise a third housing having the form of a cap disposed centred relative to the axis of the shaft and provided in order to receive said spherical element which is mounted freely in said third housing.

According to another embodiment, the spherical element can be integral with at least one of the first and second ends of the shaft of the rotor.

According to a preferred embodiment, the fluid-supply circuit can comprise a compressed fluid reservoir and possibly a pressure multiplier provided between the air compressor or water pump and the compressed fluid reservoir.

According to a preferred embodiment, the control unit can comprise actuation means for the air compressor or water pump provided in order to actuate said air compressor or water pump only when required by the functional element.

BRIEF DESCRIPTION OF THE DRAWINGS

The aims, advantages and features of the present invention will appear more clearly in the following detailed description of an embodiment of the invention, given solely by way of example, non-limiting and illustrated by the annexed drawings in which.

DETAILED DESCRIPTION OF THE INVENTION

Figure 1:
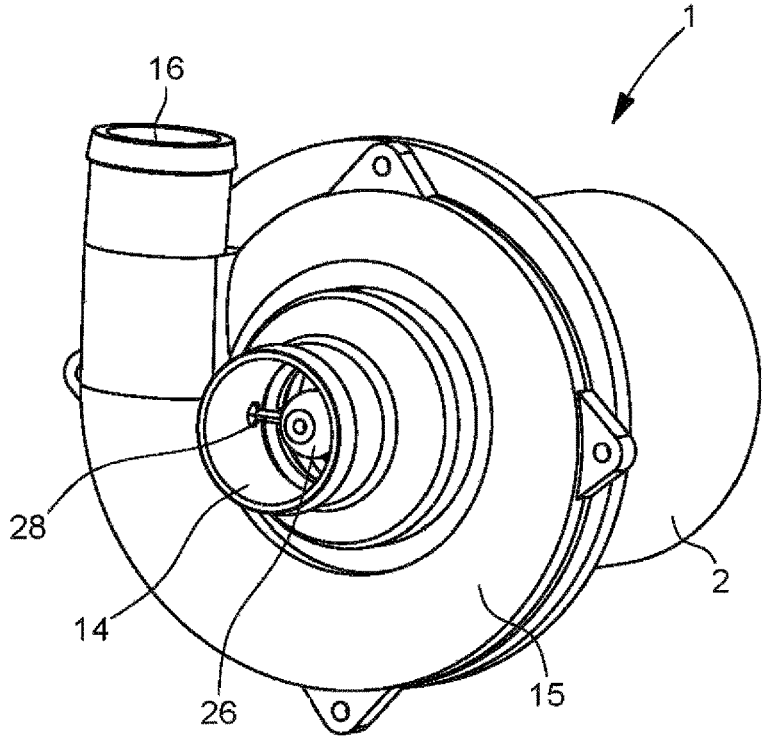
FIG. 1 represents a perspective view of a high-speed air compressor or water pump used in a machine according to the invention.
Figure 2:
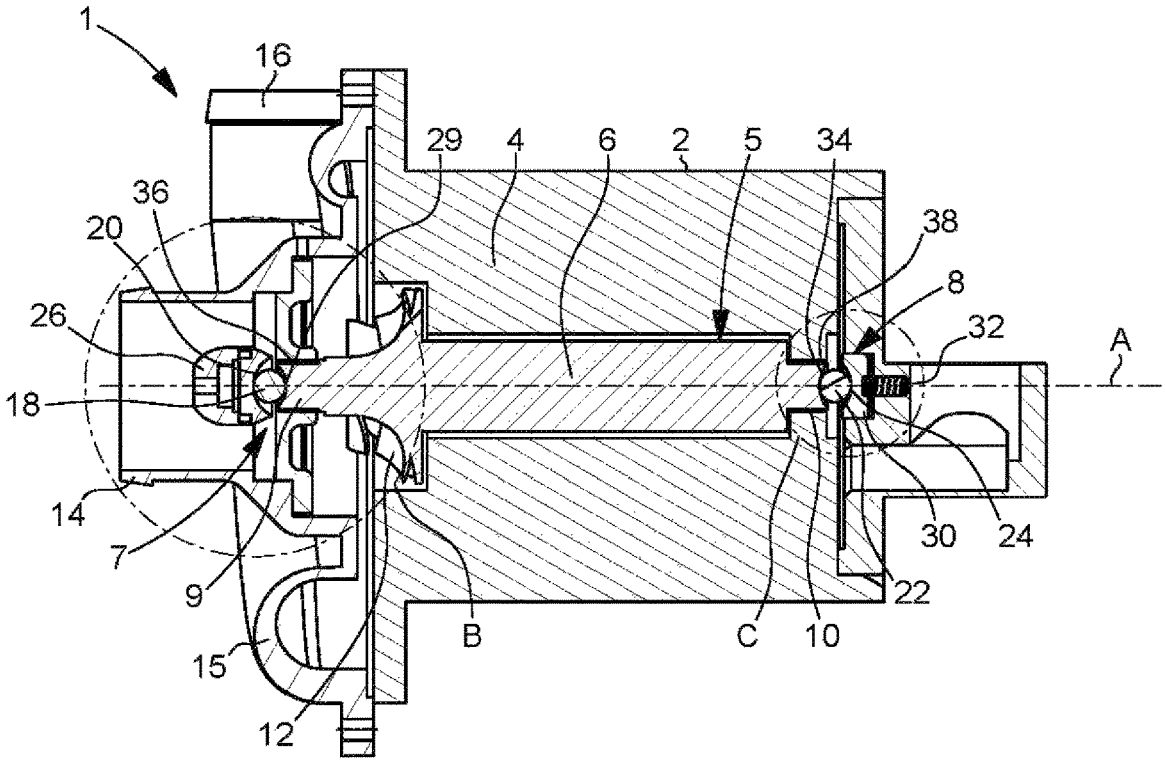
FIG. 2 represents a sectional view of the compressor of FIG. 1, FIGS. 3 and 4 are enlarged views of zones B and C respectively of FIG. 2.

With reference to FIGS. 1 and 2, there is represented a high-speed air compressor or water pump 1, of the turbo-compressor or centrifugal compressor type, the air compressor being used in order to increase the pressure of the air and the water pump being used in order to increase the pressure of the water. In the following description, the term "fluid" can be air when it is associated with a compressor or water when it is associated with a pump.

In a manner known per se, the air compressor or water pump 1 comprises a frame 2 in which there are mounted a stator and a rotor, represented schematically with the references 4 and 5, respectively. The stator 4 and the rotor 5 interact in order to form a permanent-magnet synchronous electric motor (brushless motor).

The rotor 5 comprises a shaft 6 mounted rotatably on the frame 2 about an axis A by means of a first bearing 7 and a second bearing 8, the first bearing 7 being provided in order to support the first axial end 9 of the shaft 6 and the second bearing 8 being provided in order to support the second axial end 10 of the shaft 6. The first and second bearings 7 and 8 will be described in detail hereafter.

The shaft 6 carries a turbine 12 disposed on the side of the first axial end 9. It is of course possible to provide several turbines.

The air compressor or water pump 1 likewise comprises a channel 15 for fluid supply in the direction of the turbine 12, a body 15, and also an outlet channel 16 for compressed fluid, these elements being integral with the frame 2.

These various elements of the air compressor or water pump are known to the person skilled in the art and do not require detailed description here.

According to the invention, the first bearing 7 comprises a first spherical element 18 disposed on the first end 9 of the shaft 6, centred relative to the axis A of the shaft 6 and a first housing 20 provided on the frame 2 having the form of a cap disposed centred relative to the axis A of the shaft 6 and provided in order to support said first spherical element 18.

Similarly, the second bearing 8 comprises a second spherical element 22 disposed on the second end 10 of the shaft 6 centred relative to the axis A of the shaft 6 and a second housing 24 provided on the frame 2 having the form of a cap disposed centred relative to the axis A of the shaft 6 and provided in order to support said second spherical element 22.

Figure 3:
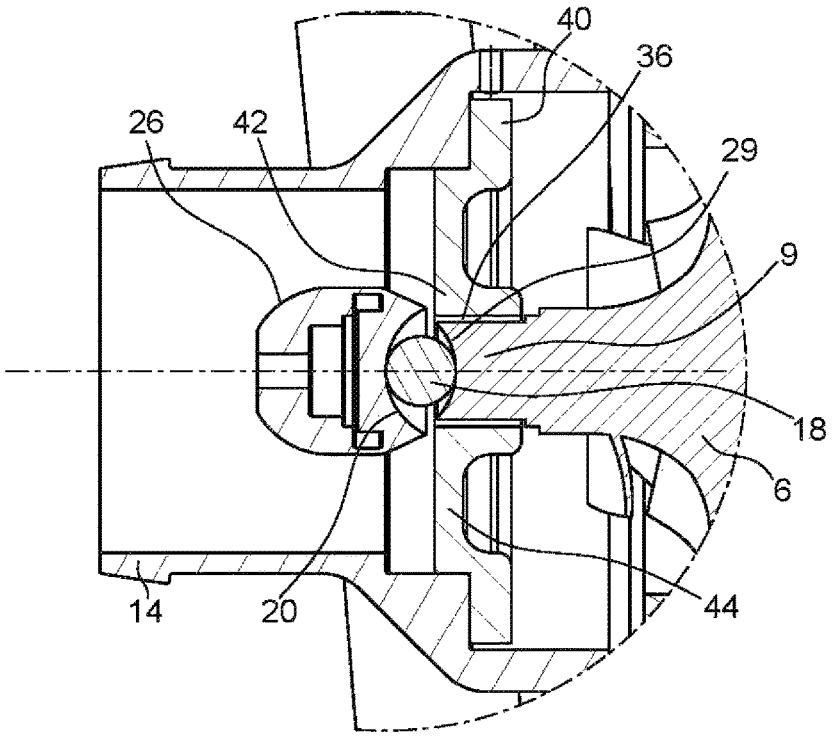

As FIG. 3 shows more precisely, the first housing 20 supporting the first spherical element 18 is provided in the fluid-supply channel 14. To this end, a first support element 26 having a truncated ovoidal form is disposed centred relative to the axis A of the shaft 6 in the fluid-supply channel 14. The first housing 20 has the form of a cap, with a full surface, produced at the end of the first support element 26 which is directed towards the interior. The radius of the cap forming the first housing 20 is greater than the radius of the first spherical element 18. The dimensions of the first housing 20 and of the first spherical element 18 are such that said first spherical element 18 is in contact with the inwardly curved base of the first housing 20. Preferably, the cap forming the first housing 20 and the first spherical element 18 are perfectly spherical in order to have a tangential contact between said first housing 20 and said first spherical element 18. The first support element 26 is retained on the interior walls of said fluid-supply channel 14 by means of three branches 28 (cf. FIG. 1). These branches 28 are at a spacing one from the other in order to allow fluid to enter into the air compressor or water pump.

According to the represented embodiment, the first axial end 9 of the shaft 6 comprises a third housing 29 having the form of a cap, with a full surface, disposed centred relative to the axis A of the shaft 6 and provided in order to receive the first spherical element 18 which is mounted freely in said third housing 29. The radius of the cap forming the third housing 29 is greater than the radius of the first spherical element 18. The dimensions of the third housing 29 and of the first spherical element 18 are such that said first spherical element 18 is in contact with the inwardly curved base of the third housing 29. Thus, the first spherical element 18 has the form of a ball mounted freely between the two caps forming the first and third housings 20, 29 between which the first spherical element 18 is retained. Preferably, the cap forming the third housing 29 and the first spherical element 18 are perfectly spherical in order to have a tangential contact between said third housing 29 and said first spherical element 18. The radius of the cap forming the third housing 29 can be equal to or different from the radius of the cap forming the first housing 20.

Figure 4:
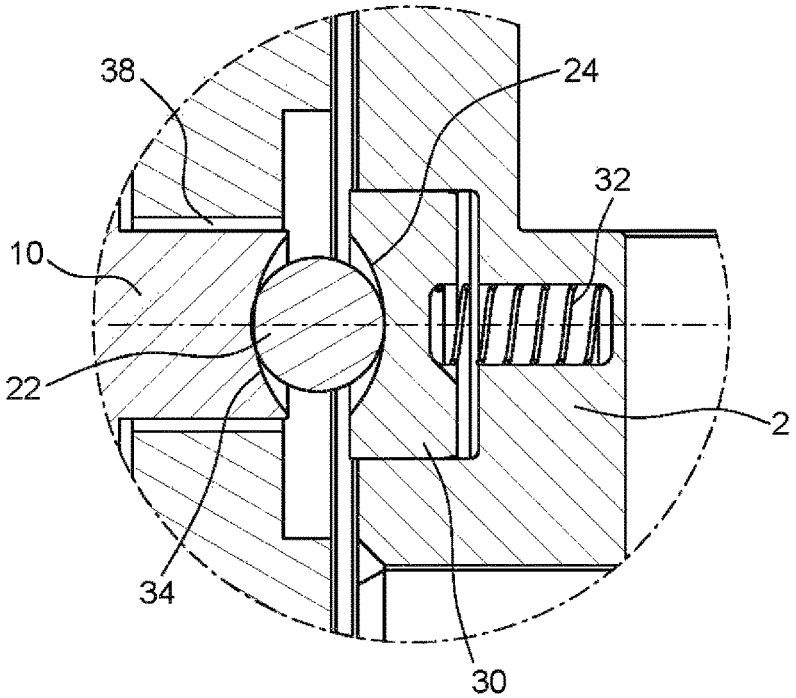

As FIG. 4 shows more precisely, the second housing 24 supporting the second spherical element 22 is provided in a second support element 30 disposed in the frame 2, centred relative to the axis A of the shaft 6, and opposite the first support element 26. The second housing 24 is formed in the second support element 30 in the form of a cap, with a full surface, disposed opposite the shaft 6. The radius of the cap forming the second housing 24 is greater than the radius of the second spherical element 22. The dimensions of the second housing 24 and of the second spherical element 22 are such that said second spherical element 22 is in contact with the inwardly curved base of the second housing 24. Preferably, the cap forming the second housing 24 and the second spherical element 22 are perfectly spherical in order to have a tangential contact between said second housing 24 and said second spherical element 22. The second support element 30 is mounted to slide in the frame 2 to which it is connected by elastic means 32, such as a spring, making it possible to absorb clearance variations between the rotor 5 and the stator 4.

According to the represented embodiment, the second axial end 10 of the shaft 6 comprises a fourth housing 34 having the form of a cap, with a full surface, disposed centred relative to the axis A of the shaft 6 and provided in order to receive the second spherical element 22 which is mounted freely in said fourth housing 34. The radius of the cap forming the fourth housing 34 is greater than the radius of the second spherical element 22. The dimensions of the fourth housing 34 and of the second spherical element 22 are such that said second spherical element 22 is in contact with the inwardly curved base of the fourth housing 34. Thus, the second spherical element 22 has the shape of a ball which is mounted freely between the two caps forming the second and fourth housings 24, 34 between which the second spherical element 22 is retained. Preferably, the cap forming the fourth housing 34 and the second spherical element 22 are perfectly spherical in order to have a tangential contact between said fourth housing 34 and said second spherical element 22. The radius of the cap forming the fourth housing 34 can be equal to or different from the radius of the cap forming the second housing 24.

According to another embodiment variant, not represented, the first spherical element 18 is integral with the first axial end 9 of the shaft 6. Similarly, the second spherical element 22 can be integral with the second axial end 10 of the shaft 6. To this end, the spherical element 18, 22 can be glued, driven-in on the end of the shaft 6 or formed in a single piece with said shaft 6.

The spherical element is produced preferably in ceramic material, or in any other suitable material, said material being able to have a surface treatment with a sliding effect (for example a coating made of polytetrafluorethylene, such as Teflon®, or any other suitable coating known to the person skilled in the art in order to have an extremely low coefficient of friction).

Advantageously, the air compressor or water pump 1 comprises, in addition, a first and a second aerodynamic bearing, provided substantially on each side of the shaft 6 of the rotor, towards the first and second axial ends 9 and 10, and represented schematically with the references 36 and 38.

According to the embodiment represented in FIG. 3, the first aerodynamic bearing 36 is provided upstream of the turbine 12. To this end, a third support element 40 is provided, having a central body 42 disposed centred relative to the axis A of the shaft 6 in the fluid-supply channel 14, downstream of the first support element 26. The first aerodynamic bearing 36 is housed in the central body 42. The third support element 40 is retained on the interior walls of said fluid-supply channel 14 by means of three branches 44. These branches 44 are at a spacing one from the other in order to allow fluid to enter into the air compressor or water pump 1. These branches 44 comprise channels which make it possible to supply air to the first aerodynamic bearing 36.

In another variant, not represented, the first aerodynamic bearing can be provided downstream of the turbine 12. The channels which make it possible to supply air to the first aerodynamic bearing 36 can therefore be provided in the frame 2, which makes it possible to simplify the construction of the assembly.

The second aerodynamic bearing 38 is provided near the second axial end 10, and can be disposed in order to ensure the axial and radial retention. According to a non-represented variant, it is possible to connect the second support element 30 to an electromagnetic system which makes it possible, at low speed or in the case of a change in speed, to position said second support element 30 in order to support the second spherical element 22 so as to ensure central positioning of the shaft 6 in order to guarantee the functional axial and radial clearance at the level of the second aerodynamic bearing 38. In the other cases, the electromagnet system is provided in order to distance the second support element 30 from the second spherical element 22, and to free said second spherical element 22, the aerodynamic bearing 38 being therefore sufficient to guarantee the functional axial and radial clearance.

The aerodynamic bearings used are known to the person skilled in the art and do not require detailed description here. It is very evident that the use of aerodynamic bearings is optional, only the first and second bearings 7 and 8 being able to be used.

Figure 5:
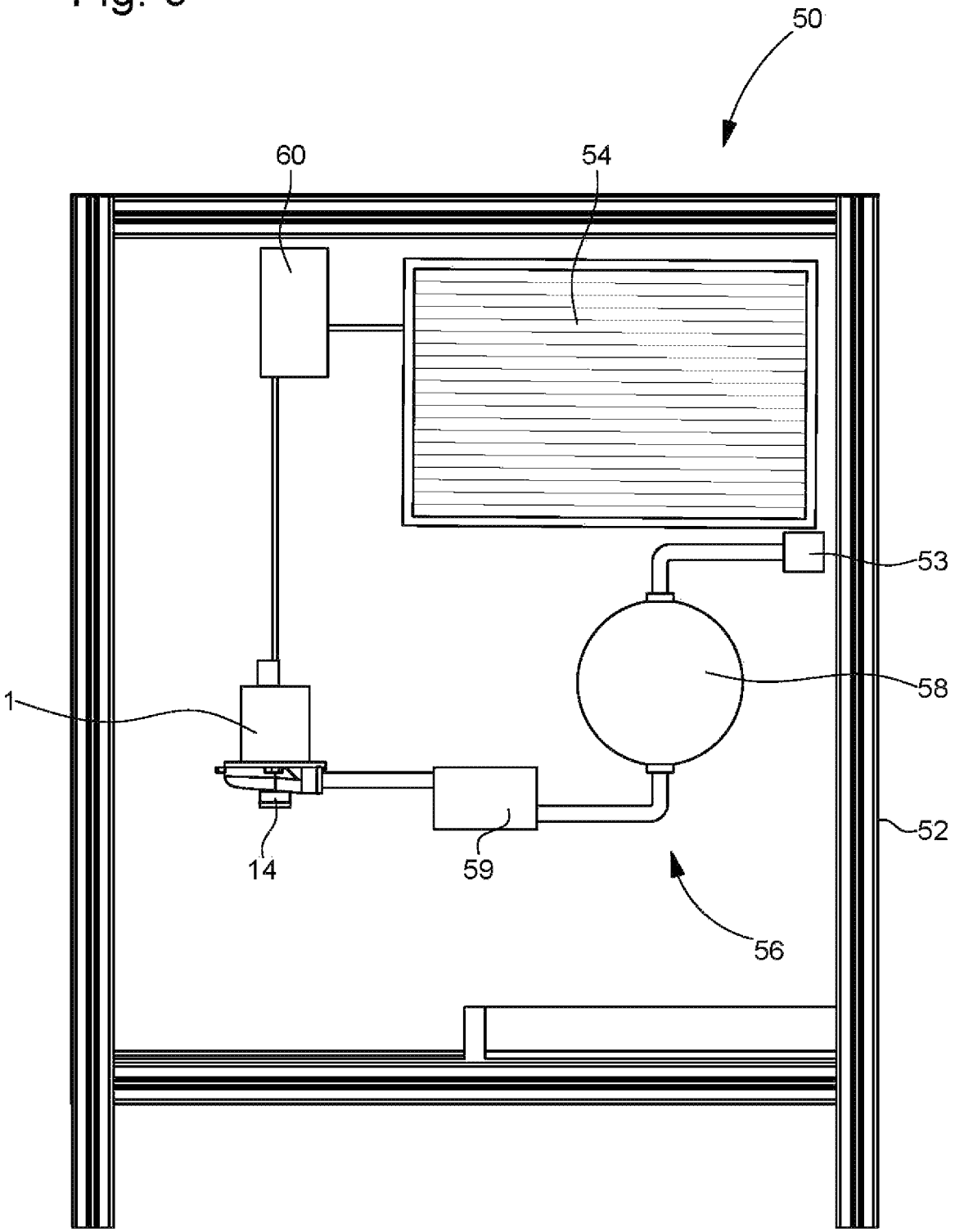
FIG. 5 illustrates schematically a machine according to the invention.

With reference to FIG. 5, the machine 50 according to the invention comprises a main frame 52 including at least one functional element 53 which makes it possible to achieve the function of the machine, and a control unit 54. According to the invention, the machine comprises an air compressor or water pump 1, as described above, said air compressor or water pump 1 being integrated in the machine, inside the main frame 52. To this end, the main frame 52 comprises a fluid inlet provided in order to supply the air compressor or water pump 1 and to supply the fluid at the level of the fluid-supply channel 14. The main frame 52 likewise encloses a supply circuit 56 provided in order to supply the compressed fluid leaving the air compressor or water pump 1 to the functional element 53.

The main frame 52 likewise includes a compressed fluid reservoir and also a pressure multiplier 59 provided between the air compressor or water pump 1 and the compressed fluid reservoir 58.

In addition, the main frame 52 includes a control unit 54 of the air compressor or water pump 1 provided in order to actuate the air compressor or water pump 1.

The control unit 54 is provided in order to communicate with the control unit actuation means 60 in order to actuate the air compressor or water pump 1 only when needed by the functional element 53.

Preferably, the air compressor or water pump 1 is disposed in the machine 50 by positioning the axis A of the shaft 6 of the rotor 5 vertically. This vertical position and also the bearings used according to the invention comprise a single centred spherical element which makes it possible to retain, in the centre, the weight of the rotor 5 and to reduce, to a maximum, the risks of displacement of the shaft 6. There is therefore autocentring of the shaft 6, the bearings used according to the invention allowing axial and radial retention. Furthermore, the use of aerodynamic bearings in combination with the bearings used according to the invention makes it possible to retain functional radial and axial clearance during start-up or a change in speed of the rotor 5.

The air compressor or water pump used in the invention makes it possible to achieve very high speeds of rotation, between 100,000 rpm and 1,000,000 rpm. These very high speeds make it possible to provide an air compressor or water pump of smaller dimensions for the same power, allowing integration thereof in the main frame of a machine. Any connection of the machine to an air compressor or water pump belonging to a central network is dispensed with. Thus, the compressed fluid-supply circuit to the functional element is very short. This reduces, on the one hand, the risks of leakage and, on the other hand, avoids pollution which is able to occur during transport of the compressed fluid through a central network. This likewise allows a very rapid reaction time of the air compressor or water pump, such that the latter can function solely upon demand of the functional element. When no compressed fluid is demanded by the functional element 53, the air compressor or water pump is stopped such that there is no consumption of energy during this down time, the result of which is a reduction in the global energy consumption of the machine. Furthermore, the air compressor or water pump used in the invention functions without a lubrication agent such that no lubricant is at risk of polluting the compressed fluid.

The machine according to the invention can be used in numerous applications, such as industrial, medical, pharmaceutical, foodstuff, automobile applications, in particular for supplying compressed air, or in refrigeration, heating or air-conditioning applications, for supplying compressed fluid.

The invention claimed is:

1. A machine comprising:

a main body comprising at least one pressurized fluid receiving element and at least one control unit;

an air compressor or water pump integrated in the main body, the air compressor or water pump comprising a frame in which there are mounted a stator, a rotor interacting with the stator and comprising a shaft, at least one turbine carried by the shaft, a fluid-supply channel to the turbine, and an outlet channel for pressurized fluid, the shaft of the rotor being mounted rotatably on the frame about an axis by a first and a second bearing, the first and the second bearing provided on opposite ends of the shaft and each comprising a spherical element and disposed centered relative to the axis of the shaft, the first bearing further comprising a first housing provided in the frame and having a form of a cap disposed centered relative to the axis of the shaft and provided to support its respective spherical element, and the second bearing further comprising a second housing provided in the frame and having a form of a cap disposed centered relative to the axis of the shaft and provided to support its respective spherical element;

a first end of the shaft of the rotor comprises a third housing having a form of a cap disposed centered relative to the axis of the shaft and provided to receive the spherical element which is mounted between the third housing and the first housing of the first bearing;

the air compressor or water pump comprising:

at least two aerodynamic bearings provided substantially on each side of the shaft of the rotor, a first aerodynamic bearing of the at least two aerodynamic bearings provided upstream of the turbine; and a first, a second, and a third support element, the third support element disposed centered relative to the axis of the shaft in the fluid supply channel, the third support element including a central body that is retained on walls of the fluid-supply channel by branches between which fluid can circulate, the central body including a cavity in which the first aerodynamic bearing is housed, the first aerodynamic bearing being housed radially outside of the third housing, wherein the main body comprises a fluid inlet to supply the air compressor or water pump and a supply circuit to supply the pressurized fluid to the pressurized fluid receiving element.

2. The machine according to claim 1, wherein the first housing is provided in the fluid-supply channel.

3. The machine according to claim 2, wherein the first housing is provided in the first support element disposed centered relative to the axis of the shaft in the fluid-supply channel, and retained on walls of the fluid-supply channel by branches between which fluid can circulate.

4. The machine according to claim 1, wherein the second housing is provided in the second support element disposed in the frame centered relative to the axis of the shaft and opposite the first support element.

5. The machine according to claim 4, wherein the second support element is mounted to slide in the frame and is connected to the frame by elastic means provided to absorb clearance variations between the rotor and the stator.

6. The machine according to claim 1, wherein a second aerodynamic bearing of the at least two aerodynamic bearings is provided downstream of the turbine.

7. The machine according to claim 1, wherein a second aerodynamic bearing of the at least two aerodynamic bearings is provided at a level of the end of the shaft of the rotor, on an opposite side to the fluid-supply channel.

8. The machine according to claim 1, wherein the second end of the shaft of the rotor comprises a fourth housing having a form of a cap disposed centered relative to the axis of the shaft and provided to receive the spherical element on the second end of the shaft which spherical element is mounted freely in the fourth housing.

9. The machine according to claim 1, wherein the spherical element is integral with at least one of the first and second ends of the shaft of the rotor.

10. The machine according to claim 1, wherein the supply circuit comprises a pressurized fluid reservoir and a pressure multiplier, the pressure multiplier being provided between the air compressor or water pump and the pressurized fluid reservoir.

11. The machine according to claim 1, wherein the control unit comprises actuation means for the air compressor or water pump to actuate the air compressor or water pump only when required by the at least one pressurized fluid receiving element.

12. The machine according to claim 1, wherein each of the first housing and the second housing further includes a curved surface that contacts a respective spherical element, the curved surface having a radius of curvature that is larger than the radius of the spherical element.

* * * * *